US009234730B1

(12) United States Patent
Cook

(10) Patent No.: US 9,234,730 B1
(45) Date of Patent: Jan. 12, 2016

(54) HAND GRENADE

(76) Inventor: Kendrick Cook, Lutz, FL (US)

( * ) Notice: Subject to any disclaimer, the term of this patent is extended or adjusted under 35 U.S.C. 154(b) by 1848 days.

(21) Appl. No.: 11/975,889

(22) Filed: Oct. 22, 2007

(51) Int. Cl.
*F42B 27/00* (2006.01)

(52) U.S. Cl.
CPC ..... *F42B 27/00* (2013.01)

(58) Field of Classification Search
USPC ..... 102/482, 487, 488, 368, 265–271, 293, 102/475, 476, 492, 497, 481
See application file for complete search history.

(56) References Cited

U.S. PATENT DOCUMENTS

| | | | | | |
|---|---|---|---|---|---|
| 34,302 | A | * | 2/1862 | Jones | 102/480 |
| 1,304,544 | A | | 5/1919 | Conrad et al. | |
| 1,321,699 | A | * | 11/1919 | Archer | 102/488 |
| 1,363,079 | A | | 12/1920 | Bergman | |
| 2,023,158 | A | * | 12/1935 | Williams | 102/482 |
| 2,564,751 | A | * | 8/1951 | Cook | 102/482 |
| 3,960,085 | A | * | 6/1976 | Abernathy et al. | 102/492 |
| 4,066,019 | A | | 1/1978 | Mehnert | |
| 4,210,082 | A | * | 7/1980 | Brothers | 102/401 |
| 4,220,091 | A | | 9/1980 | Israels et al. | |
| 4,259,906 | A | * | 4/1981 | Krauch et al. | 102/501 |
| 4,632,031 | A | * | 12/1986 | Jarrott et al. | 102/200 |
| 4,674,047 | A | * | 6/1987 | Tyler et al. | 89/28.05 |
| 4,699,063 | A | * | 10/1987 | Aschwanden et al. | 102/498 |
| 4,736,681 | A | * | 4/1988 | Hall et al. | 102/215 |
| 4,750,424 | A | * | 6/1988 | Hau | 102/200 |
| 4,817,532 | A | * | 4/1989 | Assmann | 102/482 |
| 4,942,820 | A | * | 7/1990 | Sawruk | 102/482 |
| 4,982,668 | A | * | 1/1991 | Bender et al. | 102/495 |
| 4,986,183 | A | * | 1/1991 | Jacob et al. | 102/200 |
| 5,014,622 | A | * | 5/1991 | Jullian | 102/312 |
| 5,291,680 | A | * | 3/1994 | Schabdach et al. | 102/220 |
| 5,295,438 | A | * | 3/1994 | Hill et al. | 102/217 |
| 5,544,589 | A | * | 8/1996 | Held | 102/492 |
| 5,654,523 | A | * | 8/1997 | Brunn | 102/498 |
| 5,700,971 | A | | 12/1997 | Rayer et al. | |
| 5,996,503 | A | * | 12/1999 | Woodall et al. | 102/498 |
| 6,065,404 | A | * | 5/2000 | Ripingill et al. | 102/498 |
| 6,412,416 | B1 | * | 7/2002 | Rouse et al. | 102/336 |
| 6,422,145 | B1 | * | 7/2002 | Gavrilovic et al. | 102/200 |
| 6,618,237 | B2 | * | 9/2003 | Eddy et al. | 102/276 |
| 6,629,498 | B1 | * | 10/2003 | Marquis | 102/215 |
| 6,644,202 | B1 | * | 11/2003 | Duniam et al. | 102/312 |
| 6,668,727 | B1 | * | 12/2003 | Kim et al. | 102/482 |
| 6,941,870 | B2 | * | 9/2005 | McClure et al. | 102/311 |
| 7,013,809 | B1 | * | 3/2006 | Munoz Bueno | 102/487 |
| 7,036,432 | B2 | * | 5/2006 | Casenave et al. | 102/492 |
| 7,197,983 | B2 | * | 4/2007 | Barth et al. | 102/487 |
| 7,213,518 | B2 | * | 5/2007 | Sutcliffe | 102/215 |
| 2002/0178955 | A1 | * | 12/2002 | Gavrilovic et al. | 102/200 |
| 2003/0029344 | A1 | * | 2/2003 | Eddy et al. | 102/200 |
| 2004/0011238 | A1 | * | 1/2004 | Ronn et al. | 102/492 |
| 2004/0163564 | A1 | * | 8/2004 | Sutcliffe | 102/266 |
| 2005/0045057 | A1 | * | 3/2005 | Casenave et al. | 102/492 |
| 2006/0266248 | A1 | * | 11/2006 | Munoz Bueno | 102/487 |
| 2007/0084376 | A1 | * | 4/2007 | Lloyd | 102/492 |
| 2008/0098921 | A1 | * | 5/2008 | Labuschagne et al. | 102/202.5 |
| 2008/0216699 | A1 | * | 9/2008 | McAleer et al. | 102/367 |
| 2009/0260534 | A1 | * | 10/2009 | Soto et al. | 102/392 |

* cited by examiner

*Primary Examiner* — Jonathan C Weber

(57) ABSTRACT

A hand grenade comprising a detonator, an explosive charge having a periphery, a hollow shell having an inner surface and an outer surface, an electronic circuit, and a power source. The hand grenade has at least two environments of control.

1 Claim, 4 Drawing Sheets

FIG 2
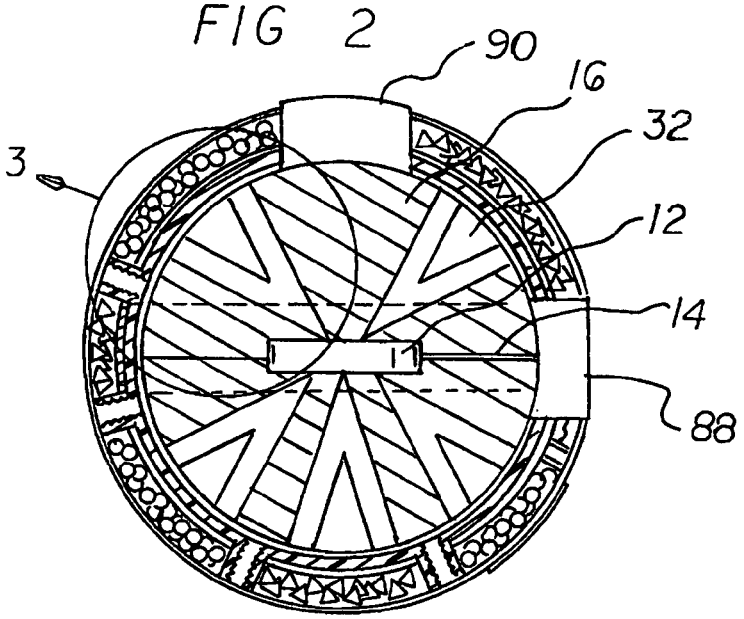
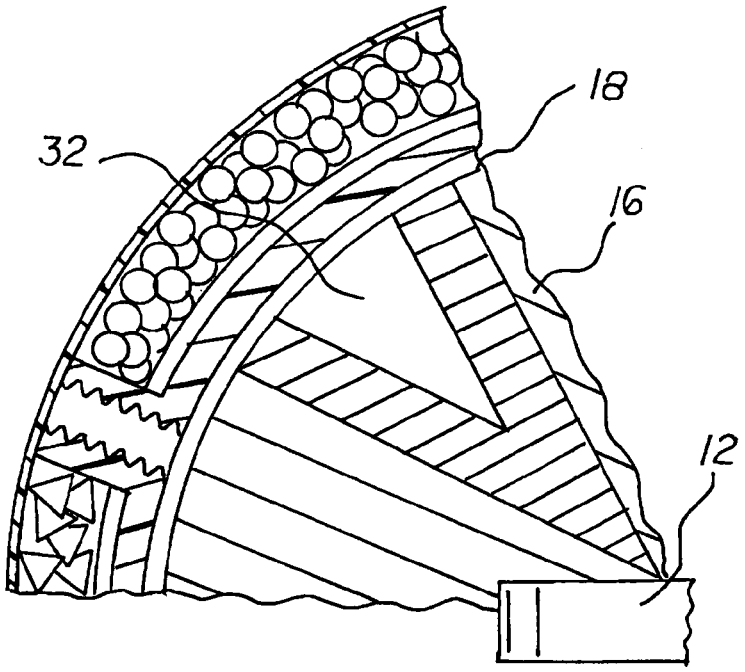
FIG 3

FIG 4
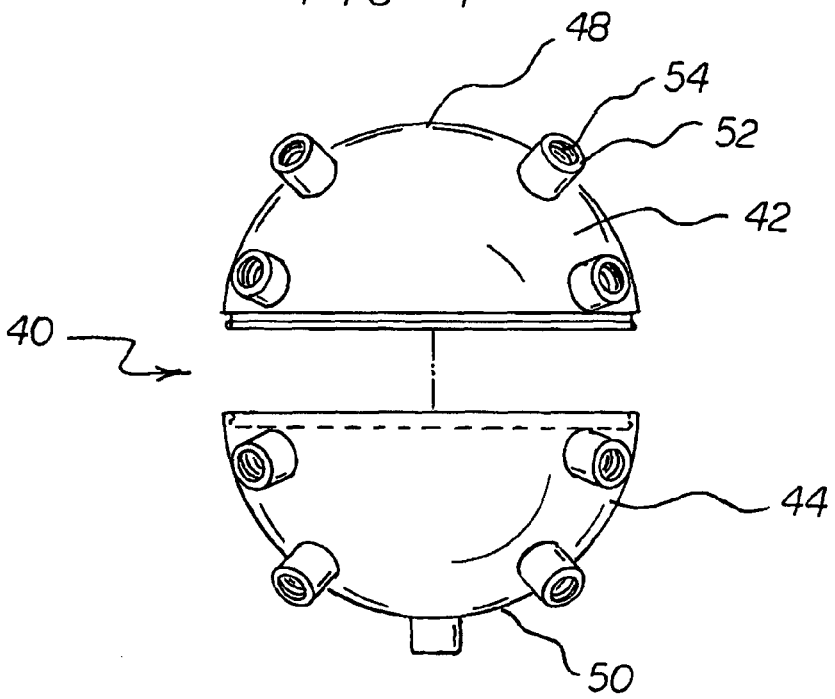
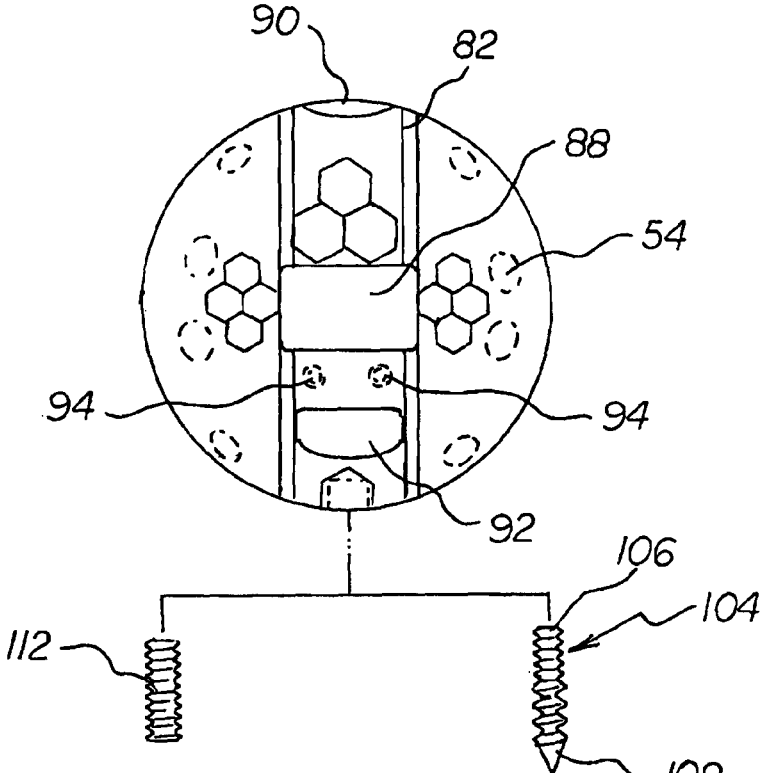
FIG 5

FIG 6
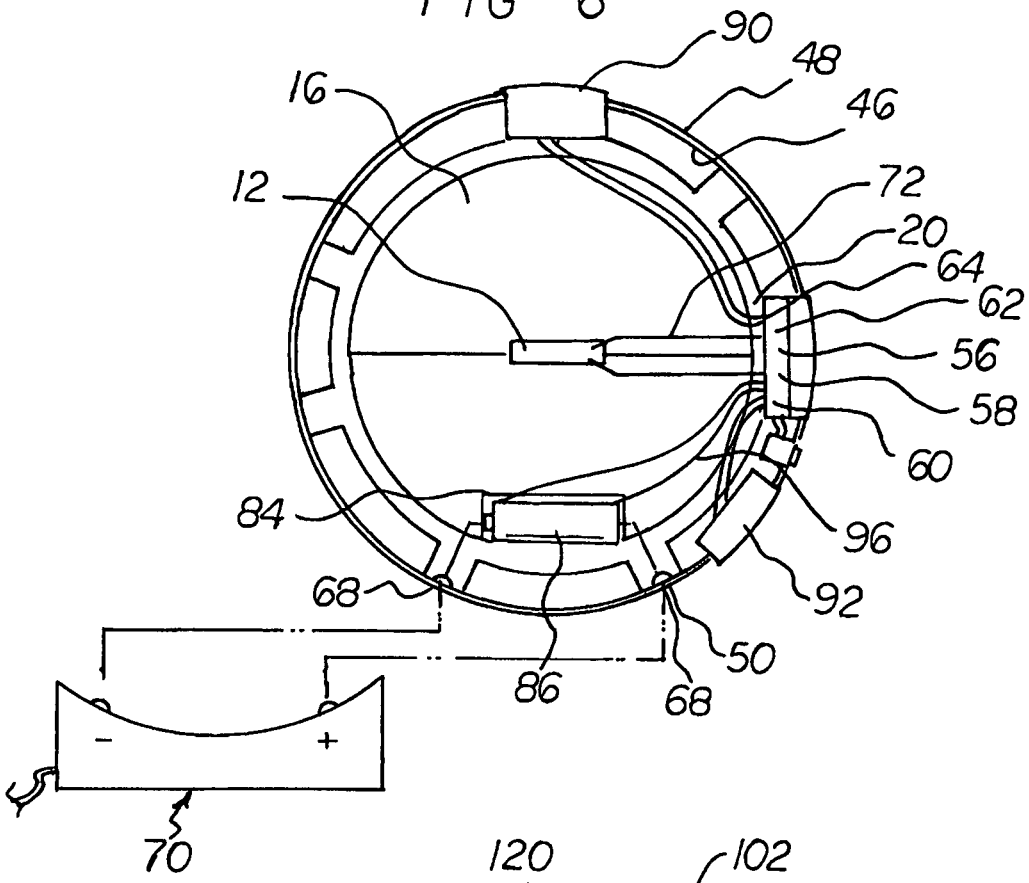
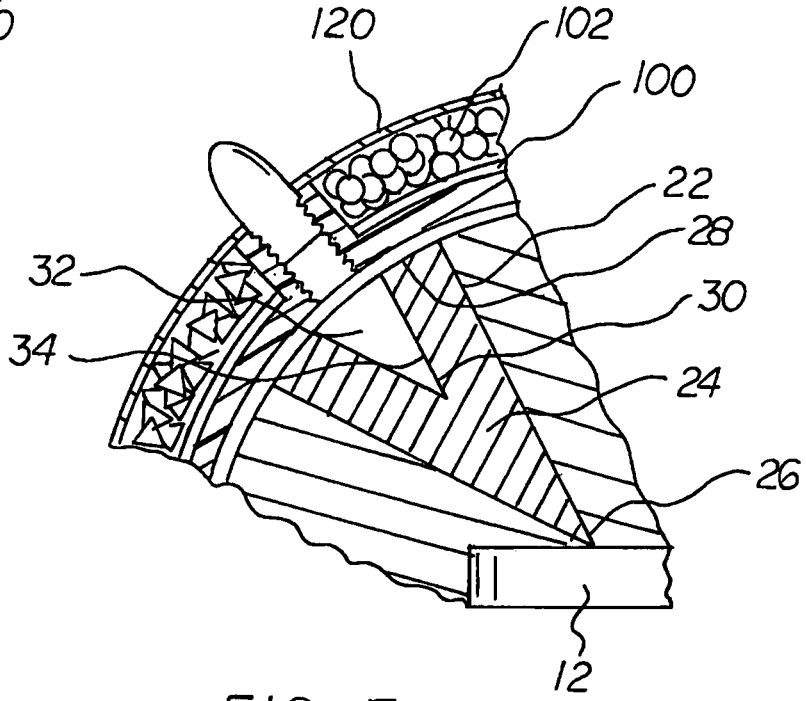
FIG 7

HAND GRENADE

BACKGROUND OF THE INVENTION

1. Field of the Invention

The present invention relates to a Hand Grenade and more particularly pertains to a hand grenade having safety and control circuitry.

2. Description of the Prior Art

The use of other hand held and hand emplaced explosive devices is known in the prior art. More specifically, other hand held and hand emplaced explosive devices previously devised and utilized for the purpose of providing a user with a hand emplaced explosive device are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,304,544 issued to Conrad et al, on May 27, 1919 discloses a hand grenade. U.S. Pat. No. 1,363,079 issued to Bergman on Dec. 21, 1920 discloses a hand grenade. U.S. Pat. No. 4,220,091 issued to Israels et al on Sep. 2, 1980 discloses a delay fuse for explosive charge. U.S. Pat. No. 4,066,019 issued to Mahnert on Jan. 3, 1978 discloses an electronic hand grenade. Lastly, U.S. Pat. No. 5,700,971 issued to Rayer et al on Dec. 21, 1997 discloses a rapid-release smoke hand grenade.

While these devices fulfill their respective, particular objectives and requirements, the aforementioned patents do not describe Hand Grenade that allows a hand grenade having safety and control circuitry and more than one level of safety.

In this respect, the hand grenade according to the present invention substantially departs from the conventional concepts and designs of the prior art, and in doing so provides an apparatus primarily developed for the purpose of a hand grenade having safety and control circuitry.

Therefore, it can be appreciated that there exists a continuing need for a new and improved hand grenade which can be used for a hand grenade having safety and control circuitry. In this regard, the present invention substantially fulfills the needs as set forth in Mil Standard 1911.

SUMMARY OF THE INVENTION

In view of the foregoing disadvantages inherent in the known types of other hand held and hand emplaced explosive devices now present in the prior art, the present invention provides an improved hand grenade. As such, the general purpose of the present invention, which will be described subsequently in greater detail, is to provide a new and improved Hand Grenade and method which has all the advantages of the prior art and none of the disadvantages.

To attain this, the present invention essentially comprises a hand grenade comprising several components, in combination.

First provided is an electrically fired detonator. The detonator has a plurality of wires to initiate the detonator.

Next provided is an explosive charge. The explosive charge has a generally round configuration with a center and a periphery. The periphery of the explosive charge has an electronic circuit recess therein. The explosive charge surrounds the detonator. The detonator, or blasting cap, is located in the approximate center of the explosive charge. The wires of the detonator pass through the explosive charge to the periphery of the explosive charge to a location adjacent the electronic circuit recess. The periphery of the explosive charge has a plurality of conical shaped recesses therein.

Next provided is a plurality of shaped charges. Each of the shaped charges has a generally conical configuration with a generally pointed apex. Each of the shaped charges is located, and contained, within one of the conical shaped recesses of the explosive charge. The apex of each of the shaped charges is located adjacent the detonator. Each of the shaped charges has a conical shaped recess located therein. Each of the conical shaped recesses of the shaped charge has an apex, with the apex of each conical shaped recess of the shaped charge being located near the center of the explosive charge.

Next provided is a plurality of penetrators. Each penetrator has a generally hollow conical configuration. Each penetrator having an apex. Each penetrator is located within the conical shaped recess of the shaped charge, with the apex of each of the penetrators being located adjacent the apex of the shaped charge.

Next provided is a hollow spherical shell. The shell may be made of a metal, such as aluminum, or of a synthetic, such as plastic. Any rigid material will suffice. The shell has a generally round configuration, with an upper hemisphere and a lower hemisphere. The upper and lower hemispheres are coupled together to form the round hollow shell. The coupling may by way of an adhesive, a weldment or by use of a compression fitting. The hollow shell has a concave internal surface and a convex first portion outer surface and a convex second portion outer surface, with a wall thickness there between. The shell also has a plurality of round threaded tubular protuberances located on the second portion outer surface. Each of the threaded tubular protuberances form a passageway through the wall of the shell communicating the internal surface of the shell with the external surface of the shell.

Next provided is an electronic circuit. The electronic circuit has a plurality of components comprising a memory, a timing device, a processor, a program, and a plurality of input ports. The electronic circuit is configured to control the initiation of the detonator. The electronic circuit is electronically coupled to the detonator. The electronic circuit is located in the electronic circuit recess of the explosive charge and contained within the spherical shell. The input ports are received by, and mated with, the tubular protuberances of the shell wall.

Next provided is a sensing strip. The sensing strip is located on the first portion outer surface of the shell. The sensing strip has a plurality of wires. The wires pass from the outside of the shell, through a wire aperture in the shell, to the internal surface of the shell. The sensing strip wires are electronically coupled to the electronic circuit.

Next provided is a battery housing and an associated battery. Also provided is a viewing screen and a plurality of actuator buttons for input from a user. The battery housing, viewing screen, and actuator buttons are coupled to the first portion outer surface of the shell. The battery, viewing screen, and actuator buttons are electronically coupled to the electronic circuit, with a plurality of wires passing from the battery, viewing screen, and actuator buttons through the shell wall and into the interior of the shell to couple the battery and viewing screen and actuator buttons to the electronic circuit.

Next provided is an adhesive layer. The adhesive layer covers the second portion outer surface of the shell.

Next provided is a plurality of external fragmentation projectiles. The external fragmentation projectiles are coupled to the adhesive layer located on the second portion outer surface of the spherical shell.

Next provided is an attachment means. The attachment means has a threaded end with a penetration point and an attachment end. The thread of the threaded end is sized to be received by, and mate with, the thread of the shell wall protuberances.

Lastly provided is a rubber layer. The rubber layer encloses the exterior surface of the shell but excludes the viewing screen, actuator buttons, and adjustment buttons. The rubber layer surrounds the viewing screen and input ports, adjustment buttons and actuator buttons. The layer has a thickness so as to allow perforation of the layer by the penetration point of the threaded end of the attachment means.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand grenade which has all of the advantages of the prior art other hand held and hand emplaced explosive devices and none of the disadvantages.

It is another object of the present invention to provide a new and improved hand grenade which may be easily and efficiently manufactured and marketed.

It is further object of the present invention to provide a new and improved hand grenade which is of durable and reliable constructions.

An even further object of the present invention is to provide a new and improved hand grenade which is susceptible of a low cost of manufacture with regard to both materials and labor, and which accordingly is then susceptible of low prices of sale to the consumers such as the military and policing orgainzations, thereby making such Hand Grenade economically available to the marketplace.

Even still another object of the present invention is to provide a hand grenade for a hand grenade having safety and control circuitry.

Lastly, it is an object of the present invention to provide a new and improved hand grenade comprising a detonator, an explosive charge having a periphery, a hollow shell having an inner surface and an outer surface, an electronic circuit, and a power source. The hand grenade has at least two environments of control.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side cross sectional view, taken along line 2-2 of FIG. 1.

FIG. 3 is a close-up view of the device taken at circle 3 of FIG. 2.

FIG. 4 is an exploded view of the shell of the device.

FIG. 5 is an exploded view of the shell in relation to threaded attachments.

FIG. 6 cut away view of the interior of the hand grenade demonstrating the relationships between the detonator, the circuitry and the actuator buttons.

FIG. 7 is a close-up view of a threaded port, showing that the port may be configured to accept a bullet from a cartridge. The bullet may be incendiary, or armor piercing. This allows the rate of explosion to propel the projectile. The rate of explosion is much faster than the speed a bullet travels after leaving a barrel of a firearm.

The same reference numerals refer to the same parts throughout the various Figures.

DESCRIPTION OF THE PREFERRED EMBODIMENT

Figure 1:
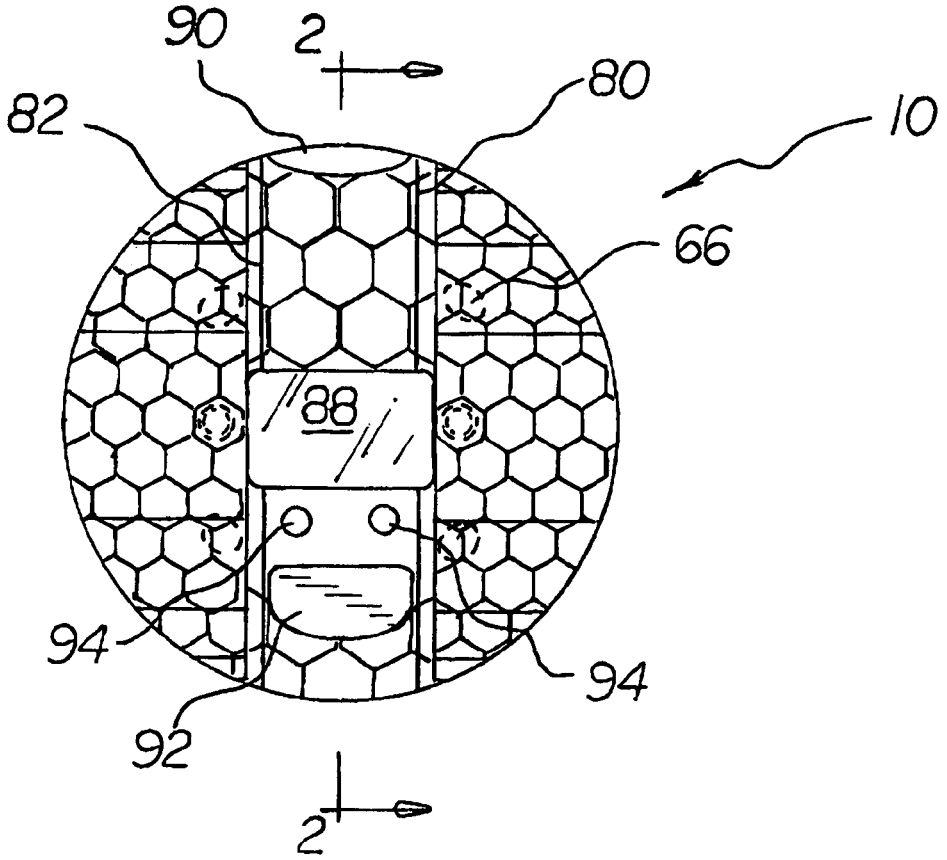
FIG. 1 is side elevational view of the device.

With reference now to the drawings, and in particular to FIG. 1 thereof, the preferred embodiment of the new and improved hand grenade embodying the principles and concepts of the present invention and generally designated by the reference numeral 10 will be described.

The present invention, the hand grenade 10 is comprised of a plurality of components. Such components in their broadest context include an explosive, a shell, an electronic circuit and an attachment means. Such components are individually configured and correlated with respect to each other so as to attain the desired objective.

A hand grenade comprising several components, in combination.

First provided is an electrically fired detonator 12. The detonator has a plurality of wires 14 to initiate the detonator. The detonator is one which is commonly available and in wide use. The detonator may be fired, or initiated, across a wide voltage range, usually in the range of 0.5 volt to 18 volts. The detonator may be any one of the commercially available explosive detonators, such as a blasting cap.

Next provided is an explosive charge 16. The explosive charge may be any one of the many commercially available explosives. In the preferred embodiment the explosive charge is classified as an insensitive munition, such that for detonation to occur there must be the presence of both heat and pressure on the explosive charge.

In other embodiments, however, any commercially available explosive charge may be used. The explosive charge may be a combination of explosives.

The explosive charge has a generally round configuration with a center and a periphery 18. The periphery of the explosive charge has an electronic circuit recess 20 therein. The explosive charge surrounds the detonator.

The detonator, such as a blasting cap, is located in the approximate center of the explosive charge. The wires of the detonator pass through the explosive charge to the periphery of the explosive charge, to a location adjacent the electronic circuit recess. The periphery of the explosive charge has at least one conical shaped recess 22 therein. One skilled in the art would recognize that there may be a plurality of conical shaped recesses in the explosive charge.

Next provided is at least one shaped charge 24, though one skilled in the art would recognize that a plurality of shaped charges may be provided.

The shaped charge has a generally conical configuration with a generally pointed apex 26. The shaped charges is located, and contained, within the conical shaped recess of the explosive charge. In the case where there are a plurality of shaped charges, each shaped charge would be contained within a recess in the explosive charge.

The apex of the shaped charge is located adjacent the detonator. The shaped charge has a conical shaped recess 28 located therein. The conical shaped recess of the shaped charge has an apex 30, with the apex of each conical shaped recess of the shaped charge being located near the center of the explosive charge.

Next provided is at least one penetrator 32. One skilled in the art would recognize that a plurality of penetrators may be utilized. The penetrator has a generally hollow conical configuration, with an apex 34. The penetrator is located within the conical shaped recess of the shaped charge, with the apex of the penetrator being located adjacent the apex of the shaped charge. In embodiments where there are a plurality of penetrators, each penetrator apex is located adjacent the apex of the shaped charge that it is located within.

Next provided is a hollow spherical shell 40. The shell has a generally round configuration, with an upper hemisphere 42 and a lower hemisphere 44. The upper and lower hemispheres are coupled together to form the round hollow shell. In the preferred embodiment the upper and lower hemispheres are compression fit together and made of aluminum. In other embodiments, however, the coupling of the upper and lower hemispheres may be accomplished by a thread, adhesive, weldment, pins, clips, snaps, or lugs. In other embodiments the shell may be made of any rigid material, such as a metal or a plastic.

The hollow shell has a concave internal surface 46 and a convex first portion outer surface 48 and a convex second portion outer surface 50, with a wall thickness there between.

The shell also has a plurality of round threaded tubular protuberances 52 located on the second portion outer surface. Each of the threaded tubular protuberances form a passageway 54 through the wall of the shell communicating the internal surface of the shell with the external surface of the shell.

Next provided is an electronic circuit 56. The electronic circuit has a plurality of components comprising a memory 58, a timing device 60, a processor 62, a program 64, and a plurality of input ports 66. The electronic circuit also has at least one adjustment button or control associated therewith.

In another embodiment the electronic circuit may also comprise a battery recharging port 68 or interface, such as an inductive charger 70.

The electronic circuit is configured to control the initiation of the detonator. The electronic circuit is electronically coupled to the detonator by wires 72. The electronic circuit is located in the electronic circuit recess of the explosive charge and contained within the spherical shell. The input ports are received by, and mated with, the tubular protuberances of the shell wall.

Next provided is a sensing strip 80. The sensing strip is located on the first portion outer surface of the shell. The sensing strip has a plurality of wires 82. The wires pass from the outside of the shell, through a wire aperture in the shell, to the internal surface of the shell. The sensing strip wires are electronically coupled to the electronic circuit.

In another embodiment the sensing strip may be used as part of an anti-handling device. Such a use would be when the grenade is of a smoke generating or chemical releasing form, non-detonating and non-explosive. The metal strips are then connected to a charging apparatus that charges the metal strips once the device is activated for a period of time. If a bystander picks up the device, the metal strips deliver a high voltage charge across the strips, much like a stun gun. Such use would be advantageous when a chemical or smoke generating grenade is used in crowd control situations to prevent the grenade from being picked up and thrown toward the police.

The sensing strip may be used as an actuator. In this configuration the sensing strip is part of an electronic circuit that senses when the grenade is thrown. Such a circuit is used in the sporting industry to calculate the speed of a thrown baseball. In this application, as long as the sensing strip senses movement, or rotation, the device would not detonate. When the sensing strip no long senses movement, a detonation signal is sent to the detonator, and the detonation sequence begins.

In another embodiment, the sensing strip may be a fragile layer that, once activated, will cause detonation when the strip integrity is affected, such as by breaking. In this embodiment, the grenade would be thrown. When the grenade impacted on the ground, the force of the landing would break the continuity of the sensing strip. This would trigger a signal for detonation. This would make the grenade impact detonating device.

In another configuration of this embodiment, there may be a back up timer, so that if the grenade does not detonate upon impact, the timer will cause detonation after a predetermined amount of time, such as five seconds or many hours.

Next provided is a battery housing 84 and an associated battery 86. Also provided is a viewing screen 88 and a plurality of actuator buttons including a first actuator button 90 and a secondary actuator button 92 and adjustment bottons/menu selection or controls 94, for input from a user. The battery housing, viewing screen, and actuator buttons are coupled to the first portion outer surface of the shell. The battery, viewing screen, and actuator buttons are electronically coupled to the electronic circuit, with a plurality of wires 96 passing from the battery, viewing screen, and actuator buttons through the shell wall and into the interior of the shell to couple the battery and viewing screen and actuator buttons to the electronic circuit.

In the embodiment in which the battery may be rechargeable, a recharging port or interface is electronically connected with the battery for recharging.

In another embodiment, the battery may have a circuit connect code. In this embodiment the circuit is activated when a specific code is entered via the actuator buttons. Unless the specific code is entered, the circuit may not be actuated. The circuit may also be used to deactivate the grenade after a specified amount of time. In this mode, if the grenade is activated, but is not detonated, after a specified amount of time the circuit goes into a inactivated mode.

The circuit may also have a circuit disconnect mode. In this mode the circuit is either inactivated or destroyed when a minimal voltage is detected in the battery.

Next provided is an adhesive layer 100. The adhesive layer covers the second portion outer surface of the shell. The adhesive layer excludes the electronic components, being the viewing screen, adjustment controls and actuators.

Next provided is a plurality of external fragmentation projectiles 102. The external fragmentation projectiles are coupled to the adhesive layer located on the second portion outer surface of the spherical shell. The fragmentation projectiles may be rounded or any other geometric shape. The projectiles may be irregularly shaped, or edged.

Next provided is an attachment means 104. The attachment means has a threaded end 106 with a penetration point and an attachment end 108. The thread of the threaded end of the attachment means is sized to be received by, and mate with, the thread of the shell wall protuberances.

The attachment means may be a hook, or barb, for attachment to an irregular surface. The attachment means may be a bolt thread 112 for joining two grenades together. The attachment means may be a spike for connecting the grenade to a wood surface, such as a tree.

Lastly provided is a rubber layer 120. The rubber layer encloses the exterior surface of the shell but excludes the viewing screen, actuator buttons, and adjustment buttons so as not to cover them.

The rubber layer surrounds the viewing screen and input ports, adjustment buttons and actuator buttons. The layer has a thickness so as to allow perforation of the layer by the penetration point of the threaded end of the attachment means.

In another embodiment a clear rubber layer covers the entire surface of the grenade, thus sealing the grenade from any moisture or elemental factors.

In another embodiment, a first rubber layer may cover most of the grenade, while a second clear rubber layer couples with the rubber layer. The clear rubber layer covers the screen thereby allowing the user to see the screen through the clear rubber layer.

The hand grenade, or hand emplaced ordnance (HEO), or device, as herein described, has a plurality of independent safety features. A safety feature is independent if its integrity is not affected by the function or malfunction of other safety features. In the herein described hand grenade, the detonation sequence includes the requirement from at least three separate inputs, in specific sequence, before the initiator, or detonator, can function. Thus, the system, as herein described, provides safety redundancy, which requires each safety feature to require a different action, and the actions must be performed in a specific sequence for arming of the HEO to occur. A single, non-redundant, safety feature would imply a single user input that would bring about function, or, in the case of an explosive device such as a hand grenade, a detonation. A single safety feature would be that such as pulling the pin on a commonly available hand grenade. Once the pin is pulled, the lever, or spoon, is urged away from the device by a spring, and the device begins the function sequence.

In the operation of the herein described system, a user will take the grenade, or HEO, in hand. The first actuator button, the green button, has a round, readily recognizable, both visually and tactilly, shape. The user presses the green, round actuator button. The screen on the HEO then lights up with a selectable menu of use. The menu would include such choices as "grenade", which means the device will be thrown, "mine" which means the device will be actuated and then left behind. In this use a subsequent handling of the device will cause detonation. "Trip" which means that the grenade will be used with a trip wire. "Remote" which means the grenade will be detonated either with a wired remote, or by radio control. The user would then use the control bottons to make the selection. The grenade may have a default mode, or may be configured to require some selection. This second "requiring selection" mode would minimize the chance that the device could be activated accidently.

To make a mode selection the user depresses the menu button. Once the user makes a menu selection, such as "grenade", the user then may make another selection, as to whether detonation occurs in five seconds, as would be the default mode, or ten seconds. Once this was done, the user would again push the green button, to lock in the selection made by the controls. The HEO would then go into ready mode, waiting for initiation of sequence.

When the user was ready to throw or place the HEO, the user would depress the red button, or final activation button, which would activate the count-down sequence timer, until detonation. As the sequence progressed, the remaining seconds before detonation appear in the viewing window.

In another embodiment the HEO would also have a faint audible signal when any final activation was made. This quiet beep, or other audible signal, would let the user know that the HEO was activated in any mode.

In still another embodiment, the circuit program of the HEO is configured to employ rotation calculation before final arming. Rotation calculation uses the metal strips that surround the HEO, or device. The metal strips detect the electromagnetic field of the earth. The circuit is configured to require a predetermined number of "counts" of the electromagnetic field. This occurs when the device is thrown. The throwing causes the device to rotate in flight, or spin. As the device spins, the metal strips detect the alterations of the earth's electromagnetic field. The number of interruptions, or number of spins, is counted by a counting circuit. Once a predetermined number of spins occurs, the device is armed and ready to function. In this mode of operation, a minimal number of seconds is selected using the screen. After the final first actuator depression the system continues to remain "safe" until it counts the predetermined number of rotations. Once this occurs, a predetermined time later, the device functions.

Safety features included in the control program are referred to as a "step time". The circuit has a step timer associated there with. The step timer is a timer circuit that is activated when the first actuator is depressed. Once the first actuator is depressed, the program waits for the selection process to occur. If a mode of operation is not selected within a predetermined time, the step timer associated with the circuit sends a cancel/reset signal to the program, and the entire system is reset. Any other depressing of secondary actuators or menu selection buttons are ineffective, unless the first actuator is first depressed and the following steps are carried out in proper sequence within the predetermined amount of time to prevent the timer from circuit reset.

When used as an area denial device, the HEO could be used as a booby trap or remotely detonated device. This would be accomplished by either selecting the mode for "mine", or selecting the mode for "remote". In the remote mode, a camera or other viewing device may be trained on the area, allowing the remote detonation to occur exactly when it is desire to occur. In this mode the grenade will not detonate unless the remote signal is given. This prevents innocent passers by from triggering the device, that is, victim activation.

In "mine" mode, the user depresses the red round actuator, then makes the selection from the menu, confirms the selection with the square or triangular shaped secondary actuator and then presses the red button again to finally activate the HEO. At this stage, the metal stripping around the exterior of the shell detects the electromagnetic field of the user's grip. The device will not arm unless there is an interruption in the electromagnetic field. Once the user places the device, and lets go of the device, the timer begins and finalizes actuation within ten seconds. Of course, on skilled in the art would recognize that an internal timer controlled by the processor and the programming of the processor can make the pre-actuation period any length of time, from seconds to days.

In the mine mode at the end of a period of time, which may be from as little as ten seconds to several hours, the device is armed, and will detonate upon being placed within another user's electromagnetic field, such as when an opposing soldier picks up the device from its resting place. In this mode the HEO may have a self-destruct mechanism that detonates the device, or disarms the device, such as by destruction of the internal program, within a specified time period, such as one day, or up to one year. This function reduces the danger that the HEO will remain dangerous after the conflict has ended, as is the problem today in the areas of past conflict, with placed, and since forgotten, mines.

When used in the "remote" mode, a remote control wire is plugged into the input port. The wire may be directly connected to a detonation control device, such as a switch, or it may be radio controlled. A trip wire, with associated detonation command, may be coupled to the HEO so that pulling on the trip wire would cause detonation of the device. Such a use would be employed to booby trap a door way or window, so that when the door opened, the device would explode.

The device has a plurality of threaded tubular protuberances in the shell. The user may employ an attachment means. Each attachment means has a threaded end with a thread to mate with the thread of the protuberance. The threaded end has a point that allows the threaded end to be pushed through the thin rubber coating of the device.

Each attachment means has an attachment end. The attachment end may be a penetrator, such as a spike. Such a configuration would allow the user to press the spike into a tree, door jamb, or window sill by pressing the spike into the structure or tree and setting the trip wire nearby.

The attachment means may be a hook. This would allow the attachment of the HEO on a branch, wire, line, rope, or netting. Using the hook attachment means, a user may toss the HEO on an enemy's netting above their position. The hook would engage the netting and hold the HEO in place, keeping it from either bouncing off, or rolling off the netting. This would allow the HEO to detonate in the air, over the position, thereby distributing shrapnel downward, into the enemy's area. One skilled in the art would recognize that the attachment means may be used in any mode of HEO operation.

When used in the "remote" mode, the user would make the function selection and then activate the device using the red button to finalize actuation. The user would then plug in the remote control device, be it a push button detonator switch, or a motion detector sending unit. The HEO would not detonate unless the detonation button was pressed or the signal from the motion detector was sent, such as in the case of using a radio frequency, or infra red light. Other means of triggering the device could be audio sensing or thermal sensing.

As described above, the HEO could be attached to surfaces using a spike or hook attachment means. The hook attachment means is threaded into the threaded apertures of the shell. The hook could be used against camouflage covered facilities, where a commonly used hand grenade would fall off of the camouflage netting. The use of the hook enables the round structure to become entangled in the netting, causing the detonation above ground level, and maximizing destructive force.

Another attachment means may be a threaded metal pin having both ends pointed and threaded. As described above, the threads on the first threaded end would allow the user to pierce the rubber coating of the HEO and thread the pin into the threaded apertures in the shell wall. The other sharp, threaded attachment end of the pin could then be threaded into another HEO, to cause a secondary explosion upon detonation. In this configuration one of the ports could be used to electronically connect the two HEOs, so that a master detonation control would control both explosive devices. This would allow a user to increase the explosive force at his or her disposal.

The sharp two ended threaded pin would also allow a user to readily attach the HEO to a tree or a board in a house, such as a door, door jamb or window sill.

The round overall shape of the HEO also lends the device to being thrown more easily than is the case with the currently issued hand grenade. The essentially smooth, round surface lends the device to not only throwing, but also rolling, such as could be done down hallways and down stairways.

In non-lethal configurations, the device may have, instead of a high explosive charge, a dispersable chemical irritant. There is included, in this configuration, a small dispersing charge. When used in this configuration, the threaded protuberances become the ports through which the chemical irritant or aerosol exits the grenade, allowing the chemical irritant to be sprayed into the area around the device upon function. In another embodiment the shell may have holes specifically placed to allow the chemical irritant, to be dispersed.

In another embodiment, a smoke generating device may be installed within the device. The smoke would also exit the device through the protuberance passageways through the shell. In other embodiments, the shell may have smoke holes specifically placed to allow the smoke to be dispersed.

In the mode of a harassment device, a small recorder, which would emit calls for help, or insulting phrases in the language or dialect of the enemy, could be used. The shell would be configured to have a small speaker located thereon, with the processor programmed to repeat insulting phrases, cries for help in the enemy's dialect, or obnoxious noises. In this mode, the calls for help may be triggered, for example, by a remote switch. The speaker would be located within a previously mined area. The calls for help would attract the enemy into the mine field, and his presence there would cause the co-placed explosive devices to function. Also used in the harassment mode is a camera which allows the placer to monitor who enters the vicinity of the device. In this function, the placer begins the detonation sequence.

Lastly, in special operations employment, the HEO may be configured to have a pass-through program. The pass-through program allows the HEO to be placed and activated in a mine mode. The HEO has a receiver associated with the circuit. The receiver is tuned to a specific frequency. The user has a fob-like device, such as is found in a car door unlocking device, is configured to generate a safety frequency. The fob-like device may also be configured to select and generate one or more other frequencies, with only one of the frequencies being the "safety frequency".

In this configuration, when the HEO is activated, its program is configured to deactivate, or be rendered safe, in the presence of the first safety frequency. The user, carrying the fob-like device, may approach and pass by the placed HEO without having the HEO function, or detonate. Once the safety frequency is no longer detected, the HEO operates as it is configured.

In this mode, a soldier may mine an area of retreat, carry out the mission, and retreat through the same, mined, area. The HEOs previously planted by the soldiers would have a program that receives a signal and remains inactive until the signal is no longer detected. In this manner special operatives may mine, or prep, an area in their line of retreat with HEOs in preparation to their hasty retreat through the area. Each of the operatives would carry a singular frequency short range transmitter which sends out a disarming signal at a specified interval. Should the soldier be pursued, he may pass through the mined area with the safety signal de-activating the mined area as he passes through, and the pursuing enemy following the soldier will then enter the mine field, tripping the mines, and suffering the consequences and discouraging further pursuit.

If the safety device falls into enemy hands, the multiple choices of a "safety signal" would decrease the chance of the enemy selecting the proper "safety signal".

In another embodiment, the HEO's circuit is structured to have a disarm override. The override may be a received specific signal, or it may be the depressing of a specific button the on the HEO, such as the first actuator, secondary actuator, or menu selection button. The disarm override may be activated when the battery voltage reaches a critically low level.

In a final embodiment, the shell may have a single larger port there through. This port has an inside surface having a thread. The thread is sized to mate with and receive the thread of a commonly used, spoon and fuse, hand grenade. In the event of electrical failure, caused by battery failure or electronics failure, a commonly available mechanical hand grenade detonating device may be screwed into the shell. In this manner the mechanical detonating device, such as that used in the RUAG grenade, herein disclosed in the IDS statement, may be threaded into the port and the HEO may be detonated by pulling of a hand grenade pin, and allowing the lever, or spoon, to separate, as is common at this time in the art.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hand grenade comprising, in combination:

a detonator;

a explosive charge; and a single detonation control having a viewing screen, with the detonation control having at least two environments of control, with the detonator having a detonation sequence requiring at least three separate inputs in a specific sequence;

a step timer circuit which resets the detonation control; and the detonation control also having safety redundancy.

* * * * *